United States Patent [19]

Walton et al.

[11] 4,346,252

[45] Aug. 24, 1982

[54] SOFT WALL HANGER FOR FURNACE

[75] Inventors: Robert R. Walton; Finis E. Edwards, both of Shelbyville, Ind.

[73] Assignee: Wellman Thermal Systems Corporation, Shelbyville, Ind.

[21] Appl. No.: 191,952

[22] Filed: Sep. 29, 1980

[51] Int. Cl.[3] ..... F27D 1/00

[52] U.S. Cl. ..... 373/130; 373/137

[58] Field of Search ..... 13/20, 25, 35

[56] References Cited

U.S. PATENT DOCUMENTS

| | | | |
|---|---|---|---|
| 3,306,542 | 2/1967 | Nickel | 248/225 |
| 3,892,396 | 7/1975 | Monaghan | 266/43 |
| 3,987,237 | 10/1976 | Phillips et al. | 13/25 |
| 4,088,825 | 5/1978 | Carr et al. | 13/25 |
| 4,154,975 | 5/1979 | Sauder | 13/25 |

*Primary Examiner*—Roy N. Envall, Jr.

*Attorney, Agent, or Firm*—Fitch, Even, Tabin, Flannery & Welsh

[57] ABSTRACT

A furnace wall lining is formed of ceramic fiber modules or batts arranged in stacks or layers between more rigid layers of insulating material to which are connected hangers for supporting electrical resistance heating elements. The more rigid insulating layers are preferably a dense fiber board insulating material having openings into which may be hooked one end of an elongated hanger which lies in a groove across the top face of the rigid insulating layer. An end of the hanger projects inwardly into the furnace chamber from the inner face of the furnace lining and supports the heating element. The rigid layers may be used to compress a stack of soft wall batts therebetween.

26 Claims, 8 Drawing Figures

SOFT WALL HANGER FOR FURNACE

This invention relates to a method of installing electric heating elements in a furnace and to apparatus for supporting electric heating elements in a furnace insulated with ceramic fiber modules or batts.

More particularly, the present invention is directed to a method and apparatus for supporting electric resistance heating elements or coils which are usually in the form of round cross section wires or flattened ribbons of metal supported by hangers from the furnace wall. Typically, such industrial electric furnaces or ovens are used for annealing. Heretofore such furnaces have been generally made with an internal firebrick lining encased by a steel outer wall. The electric resistance heating elements are subject to failure; there occurs, not infrequently, a need to replace or repair the electric heating elements which requires a shutting down of the furnace and allowing a cooling of the furnace until the workers are able to move into an internal chamber within the furnace to effect the repairs. Also, the hangers supporting heating elements may fail and need to be repaired. The dense firebrick for the linings requires a considerably cooling down period before the repairs can be made. Firebrick linings absorb a considerably amount of heat when heating the furnace and this is waste of heat and time.

By use of batts and modules of ceramic fiber insulation usually called "softwall" lining materials, the shutdown time and the energy loss during repairs can be markedly decreased from that of the dense firebrick lined, industrial furnaces. For these and other reasons, the soft wall lined industrial furnaces are becoming increasingly prevalent.

Also, the heat transfer characteristics of the soft wall lining is preferred to that of firebrick. Additionally, the lining deteriorates with age and use and it is desirable to reline or otherwise repair the lining. The bricks of the firebrick linings are difficult and time consuming to remove, as compared to the larger softwall modules, which are only mechanically interlocked, usually by pins, to the outer wall and which are not adhered to each other as in the case of firebrick.

A problem with the soft wall linings is that the lining lacks the strength and rigidity of the firebrick lining for carrying and supporting hangers for the heating elements. The hangers should be supported on lining in a manner such that there is no direct heat conductive path through the lining to the outer metal wall. Also, the soft wall modules need to be arranged and held in position against the furnace wall and preferably with sufficient contact between the stacked modules that large amounts of heat are not lost through the interfaces between insulating layers.

This problem with adequate support for softwall hangers is addressed in U.S. Pat. Nos. 4,154,975 and 4,088,825. As disclosed in the former patent, ceramic rods may be inserted into the interior of the modules, and then when modules are formed into a lining, cuts may be made from the inner face of the lining to the rods, and hangers may be inserted through the cuts to hook an end onto the internal ceramic rod. The outer ends of the hooked hanger members extend outwardly of the face of the lining and have hooked ends to support wirelike heating elements. Such a construction is not feasible for supporting ribbon heating elements nor are the rods useable in cylindrical-shaped furnaces.

U.S. Pat. No. 4,088,825 discloses several different configurations for supporting electric resistant heating elements which involve the use of supporting plates or members positioned at the interface between adjacent stacked layers of soft wall insulating material. This construction has met with some success, but an improved apparatus and method are still being sought.

Accordingly, the general object of the invention is to provide a new and improved method and apparatus for supporting electric resistance heating elements in a furnace.

A further object of the invention is to provide a new and improved furnace lining construction having hangers supporting electric resistance heating elements in an improved manner.

Other objects and advantages of the invention will become apparent from the following detailed description of the invention in reference to the accompanying drawings in which.

Figure 1:
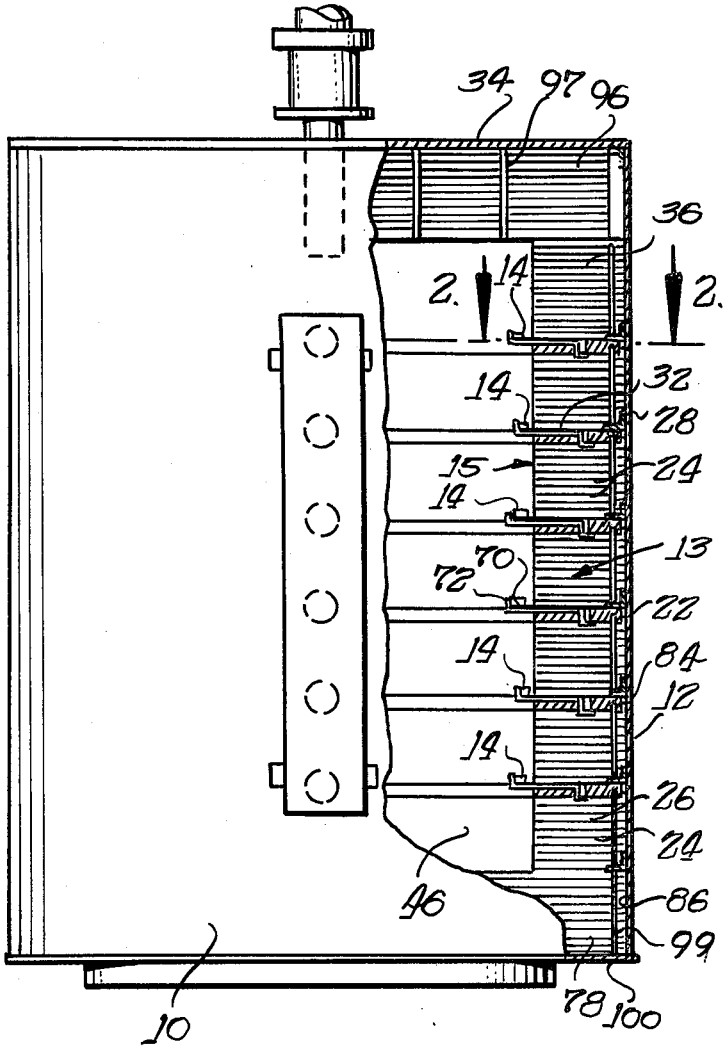
FIG. 1 is a cutaway elevation view of a furnace embodying various features of the invention.
Figure 2:
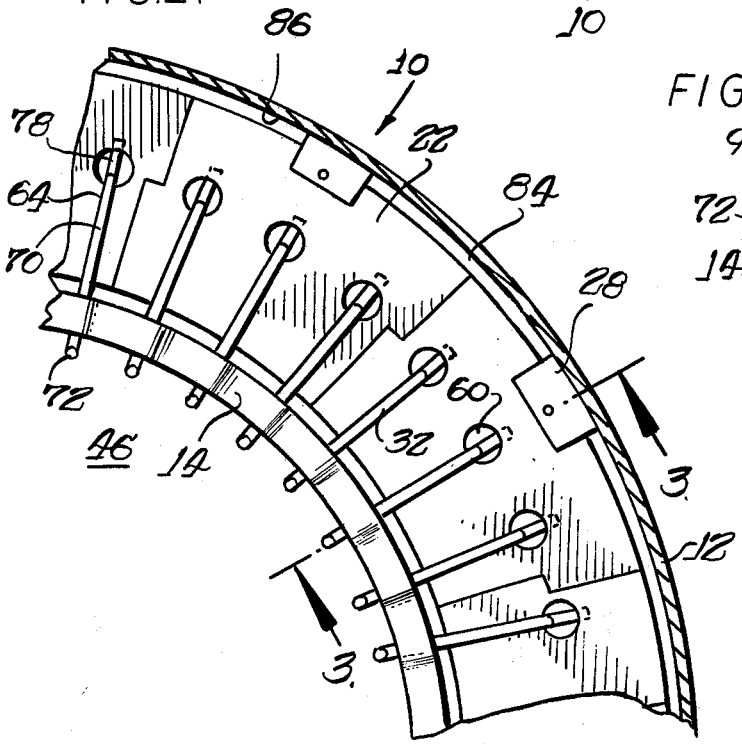
FIG. 2 is an enlarged fragmentary cross-sectional view taken along line 2–2 of FIG. 1.

As shown in the drawings for purposes of illustration, the invention is embodied in an electric resistance heating furnace 10 having an outer metal wall 12 which defines the outer shape of the furnace and which provides support for an inner insulating furnace lining 13 of insulating material which is connected and supported by the outer metal wall. In the illustrated furnace, the outer furnace wall 12 and the inner lining are cylindrical in shape to define therein an internal heating chamber in which will be placed the work pieces, usually metallic pieces for being heat treated. The heat is generated by electric resistance heating elements 14 which may be in the form of round cross sectional wires or the flat rectangular cross section ribbons illustrated herein. Typically, the heating elements are laid in serpentine fashion at locations closely adjacent to and spaced from an outer face 15 of the lining by a series of hanger means 16 which have ends on which the ribbon elements are laid.

The furnace lining 13 is formed principally of layers or batts 24 of fibers of insulating material, for example fibers of alumina and silica, which are loosely laid or connected to one another without the rigidity and adhesion therebetween as with the hard or greater density insulating materials such as firebrick. Typical "softwall" ceramic fiber materials used for these layers of batts 24 are made and sold under the following marks: KAO-WOOL marketed by Babcock and Wilcos, FIBROFRAX marketed by Johns-Mansville, CER- ROFELT marketed by Carborundum, or PYRO-BLOCK marketed by Sauder Industries, Inc. of Emporia, Kansas. As known, it is a considerably problem to form and stack these modules into a lining which has the desired density and configuration and which has anchors or other means to support the heating elements in non-conducting relationship with the outer metal furnace wall 12.

In accordance with the present invention, an improved furnace wall is formed with the soft wall modules or batts 24 being arranged in stacks or layers between more rigid layers 22 of insulating material with the hanger means 16 being connected to and supported by the rigid layers 22. More specifically, a predetermined number of softwall batts 24, e.g., ten layers, are laid in a vertical stack between a pair of rigid insulating layers 22 which compress the soft batts into a predetermined space and thereby provide thereto a predetermined compression. The hanger means 16 comprises elongated support hangers 32 having ends 33 detachably connected with the rigid layer and having opposite ends 34 projecting outwardly beyond the face 15 of the lining to support the heating elements 14. By making the rigid layers 22 of a dense and more rigid fiberboard insulating material, the hangers 32 may be laid on and supported by the fiberboard layers 22 against drooping, while the metal hangers remain insulated from the outer metal wall 12. Preferably, the rigid layers 22 are connected to a support means, such as clip angles 28, projecting inwardly from the furnace wall to precisely locate the insulating layers relative to one another. In a known manner, elongated vertical pins 30 may extend from the clip angles 28 to pierce the softwall layers 24.

Referring now to FIG. 1, the invention will be described in greater detail hereafter. The preferred rigid layers 22 are boards having a length and thickness approximating one of the soft wall layers 24 although the size and shape thereof may be varied. The illustrated rigid layers 22 are comprised of high-density ceramic fiber insulating material such as that sold under the trade name KAO-WOOL M Board by Babcock and Wilcox.

Figure 5:
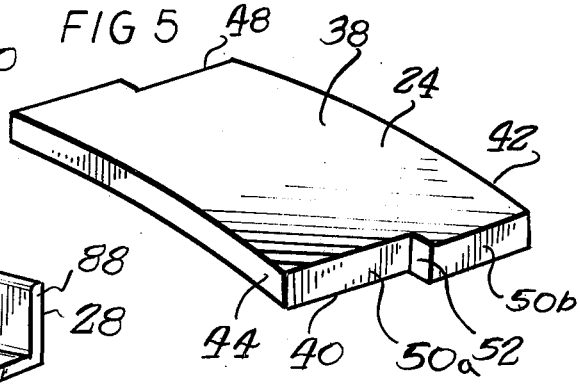
FIG. 5 is an enlarged perspective view of a batt of soft insulating material used to construct the furnace liner.

As best seen in FIG. 5, the illustration softwall layers 24 have a generally flat upper surface 38 and a flat lower surface 40 with the lower surface of each layer abutting the upper surface of an underlying softwall layer at an interface therebetween. When used in a cylindrical furnace, sidewalls 42 are curved to the curvature of the outer wall 12; and an inner furnace wall 44 is curved to define the curvature for the substantially cylindrical interior furnace cavity 46. Of course, in a rectangularly shaped furnace, the sidewalls 42 and 44 will be planar. Preferably, end walls 48 of the soft wall layers have a configuration which is matched to the end walls of adjacent lateral layers to engage along interfaces which do not define straight-line paths for heat transfer thereby blocking thermal passage between the interior furnace cavity 46 and the outer wall 12 even if some separation does occur between adjacent batts 24. Some mechanically interlocking is also achieved by these stepped end walls. On the other hand, the end walls may be planar surfaces from inner to the outer edges thereof. As, illustrated in FIG. 5, the preferred layers 24 have stepped end walls formed with two offset radial segments 50*a*, 50*b*, joined by a cross wall 52 which is generally mutually perpendicular thereto. The end walls 48 of adjacent batts 24 are mirror images of each other to interfit one with the other. Even if lateral separation of adjacent batts 24 does occur, the contact of the facing perpendicular cross walls 52 should limit heat transfer between the heating chamber 46 and the outer wall 12.

Figure 6:
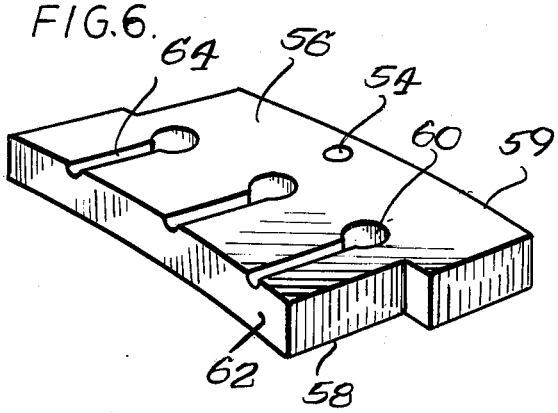
FIG. 6 is an enlarged perspective view of a slab of rigid insulating material used to construct the furnace liner.

As best seen in FIG. 6, the preferred rigid layers 24 of insulating board are similarly shaped to the soft layers, although they may be somewhat thicker.

For the purpose of allowing a detachable interconnection between the rigid layers 22 and the outer hanger ends 33, the rigid layers are formed with orifices 60 to receive therein a hooked end 33 of a hanger element 32. Herein, three orifices 60 are formed in each rigid board at arcuately spaced locations more closely adjacent the rear and outer metal wall 12 so that a long length or straight portion 70 of the hanger may be supported by top surface 56 of the rigid layer. To assist in holding the hanger elements against shifting laterally along the rigid layers or against pivoting about their outer ends, elongated grooves 64 are formed in the top surfaces of the rigid layers 22 to receive the long central segment 70 of the hanger 32. These grooves extend from the orifices 60 to an inner curved furnace wall 62 for the rigid layer 22. An outer curved wall 59 of the rigid layer will be located adjacent the metal wall. To interlock the rigid layers 22 to the clip angles 28, holes 54 are provided in the rigid layers to receive therein the pin 30 which holds the layers against shifting.

Figure 3:
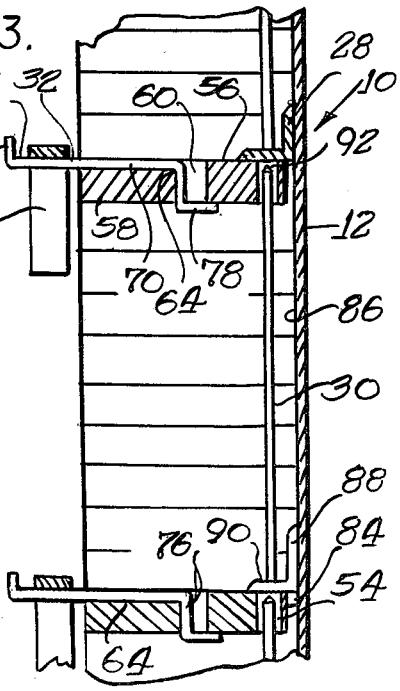
FIG. 3 is an enlarged cross-sectional view of a portion of the outer wall and liner of the furnace shown in FIG. 1.
Figure 7:
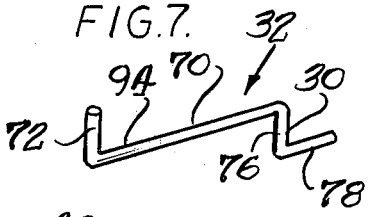
FIG. 7 is an enlarged perspective view of a hangar which interengages with the rigid slab shown in FIG. 6.
Figure 8:
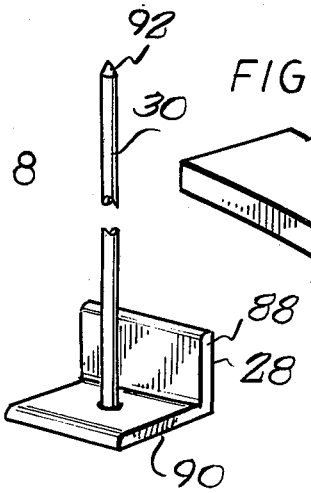
FIG. 8 is an enlarged perspective view of a clip angle and associated pin used to align the layers of liner material along the outer wall of the furnace.

In order to be able to readily attach or detach a hanger 32 from a rigid layer 22, the preferred ends 33 are formed with hooks which do not need any fasteners or mechanical devices to connect the same to the rigid layer. Herein, the hooked ends 33 are formed to interlock automatically upon being inserted into the orifices 60. Herein, the preferred hangers 32 are as best seen in FIG. 7 in the shape of a rod having the elongated central segment 70 with an inner end 72 bent perpendicularly upward therefrom to form a heating element support hook, and the hooked end 33 which detachably interengages with an orifice 60, the hooked end being coplaner with the heating element hook and including a leg 76 which angles perpendicularly downward from the central segment 70 and a lower leg 78 which angles perpendicularly outward from the downward leg and is parallel to the central segment 70. The downward leg 76 offsets the lower leg from the central segment by a distance about equal to the thickness of the rigid layer. The leg 78 has a length greater than the diameter of the orifices. The interengaging hooked outer end 33 is inserted into the orifices 60 from the upper surface 56 at an angle and then aligned, as best seen in FIG. 3, with the lower leg 78 abutting the lower surface 58 of the rigid layer 22 and the central segment 70 lying in the groove 64 and extending beyond the inner arcuate wall 62. The weight of the heating element 14 on the hanger's end holds the central segment 70 in the groove and causes the lower leg 78 to abut tightly against the underside of the rigid layer at a location outwardly of the orifice layer. The illustrated rigid layer 22 may be about 1-½ inches, with a 1-inch diameter orifice 60. The legs 78, 76 of the hanger 32 may be about 1-½ inches long so that at least ½ inch of the outward leg extends along and abuts the lower surface 58 of the rigid board.

The grooves 64 along the upper surface of the rigid layers 22 are proportioned to be substantially filled by the central segments 70 of the hangers 32. The compression of the soft layers 24, thereabove fills any airspace in the portions of the grooves 64 above the central hanger segments 70.

In the preferred embodiment of the invention, the softwall layers 22 are precisely aligned within the stack and compressed to a predetermined degree between the rigid layers 22 which are located at predetermined vertical heights by the clip angles 28 and rings 84 secured to the outer furnace wall 12. The rings 84 are welded to the inner surface 86 of the outer wall 12 at spaced vertical locations. Resting on the top of rings are the clip angles which have a horizontal leg or flange 90 abutting the top outer edge of each rigid layer 22. A vertical leg 88 of the clip angle abuts the inner surface of the outer wall 12.

The soft wall layers 22 are impaled on the upper sharp ends 92 of the vertical pins 30 carried by the horizontal flanges 90 and slid downwardly along the pins to abut the top preceding layer 22 or 24 of the lining. The number of soft wall layers 24 between the rigid layers 22 may be varied, e.g., to comprise between about 75 percent and about 95 percent of the vertical height of the lining. To remove dead airspace and to provide a degree of rigidity to the liner, the rigid layers 22 are vertically positioned to cause compression of the soft batts 24, therebetween. The compressed height of the soft batts 24 is between about 70 percent and about 90 percent of their uncompressed height. Preferably, the liner 36 may have 10 layers of 1-inch thick soft layers 24 compressed into 8 inches between successive layers of 1-½ inch-thick rigid layers 22.

Figure 4:
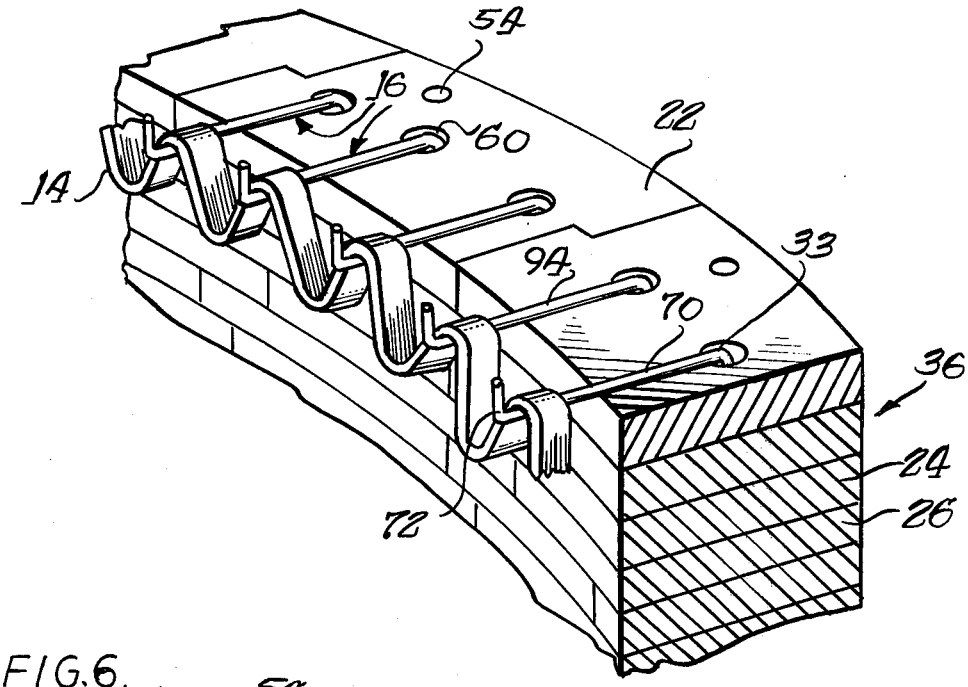
FIG. 4 is an enlarged fragmentary perspective view of the interior of the furnace of FIG. 1.

As best seen in FIG. 4, the heating elements 14 are bent into serpentine configuration and are suspended on horizontal, straight portions 94 of the horizontal central hangar segments 70 located outwardly of the liner face 15. The hangar hooks 72 prevent the heating elements 14 from sliding off the ends of the hangers. If desired, a ceramic spacer or other material may be used to hold the adjacent side of the heating element outwardly at a predetermined spacing from the lining face 15. While heating elements 14 may be formed of wire as illustrated, of flat metal ribbon, the straight flat portion 94 of the hangar provides a support surface extending across and in full line contact with the underside of the heating element in contrast to round hanger hooks used in the prior art which would engage only the edges of the heating element, such as those hangers described in U.S. Pat. No. 4,154,975.

Thus, the hangers 32 of the present invention have straight support surfaces 94 which interengage with flat heating elements 14, and since the outer hooked ends 33 are well spaced from the outer wall 12 and well spaced from any apparatus which might conduct heat or electricity to the outer wall; the hangars may be formed of the same or similar material as the heating elements 14 to expand and contract therewith. This protection against deformation adds to the life of the heating elements 14 which commonly have a relatively short life due to oxidation and thermal stress.

In the illustrated furnace, a top wall 34 of metal is also lined with a lining portion 96 comprised of soft wall layers 24 supported by pins 97 depending from the furnace top 34 and the bottom of the furnace may have a lining portion 78 comprised of softwall layers 24 impaled on pins 99 extending upward of the furnace metal bottom wall 100.

In constructing the furnace lining 36, the sidewalls are built from the bottom up with each softwall layer 24 being impaled on a pin 30 extending upward from the clip angles 28 with adjacent softwall layers in edge surface contact with each other. The successive batts 24 (as seen in FIG. 4) are preferably staggered to displace the sidewall junctions in the stacks so that any lateral separation between batts 24 will be confined to a single layer. After stacking the desired number of soft batts, a rigid layer 24 of insulating board 22 is laid on the top of the stack with the hole 54 of each rigid slab 22 receiving the end of a pin 30 extending upward from a clip angle 28. Herein, the rigid layers 22 are inserted with their radialy outer ends beneath the clip angle leg 90 with the rigid layers compressing the stack of soft wall batts 24 therebeneath. Thus, the clip angles 28 hold down the rigid layers 22 and retain the soft batts 24 in compression. After laying a rigid layer or board 22, outer ends of the hangar hooks are manipulated into the holes 60 and hooked to the boards with central segments 70 of the hangars 32 being laid in the grooves 64. The process is repeated until the furnace sidewall is lined. The upper portion 96 of the furnace lining is supported by the top metal wall 34 of the furnace 10.

Many of the advantages of the invention may now be more fully appreciated. The furnace lining provides excellent thermal insulation. The compression of the soft batt layers causes the soft batts to expand into any available free space and substantially eliminate any thermal paths between the furnace chamber and the outer metal wall 12. Sufficient insulation-filled spacing is provided between the hangars, the metal wall 12 and the clip angles, associated with the outer wall 12, that there is substantially no likelihood of electrical shorting.

The construction of the liner is relatively simple, and the construction steps may be reversed for easy maintenance when repair or replacement of components is necessary. The detachable interengagement of the hangars with the rigid batts without positive attachment facilitates their assembly and replacement.

A repair of a hanger element or insertion of a new element into hooked engagement with a rigid layer may be made without tearing down the line. That is, the orifice 60 has a known location on the rigid layer 22 and the hooked end 33 may be slid along the top of the board then worked into the orifice.

Modifications obvious to one skilled in the art may be made without departing from the scope of the present invention. The invention may be advantageously applied to furnaces having a wide variety of shapes. Likewise, the size and shape of the soft wall layers and the rigid insulating layers may be varied considerably for various reasons such as the shape of the furnace and manufacturing expedients. The particular shape of the hanger element may also be varied and in some applications, it may be desirable to positively secure the hangars to the rigid layers. Likewise, the size and shapes of the orifices 60 may be varied.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed:

1. In an electrical resistance heating furnace, the combination comprising;

an outer wall for the furnace, a vertically extending lining on the interior side of said outer wall to limit heat transfer to the outer wall, a plurality of softwall batts of ceramic fiber stacked vertically and defining a substantial portion of said lining, a plurality of layers of insulating material more rigid than said soft wall batts of substantially the same size and shape as said soft wall batts, stacked on the top of a plurality of soft wall batts at predetermined vertical locations in said lining, and hanger means releasably connected to and supported by said layers of more rigid insulating material and having portions extending inwardly from an inner face of the lining to support electrical resistance heating elements thereon.

2. A furnace in accordance with claim 1 in which said layers have openings therein and said hanger means have portions inserted into said openings and secured thereto.

3. A furnace in accordance with claim 2 in which said portions of said hanger means are formed into hooks which are hooked into said openings and in which said hanger means lay across the upper side of said more rigid layers.

4. A furnace in accordance with claim 3 in which grooves are formed in said more rigid layers and portions of said hanger means are laid in said grooves to prevent shifting and movement of said hanger means.

5. A furnace in accordance with claim 1 in which means are secured to said furnace and said more rigid layers are held by said means at locations to compress said soft wall batts therebetween.

6. For use in an electrical resistance heating furnace, having an outer wall, the combination comprising:

an inner liner having a plurality of vertically spaced layers of rigid insulating boards and a plurality of layers of softer insulating batts stacked between successive layers of said rigid boards, said layers being of substantially the same size and shape, hanger means releasably connected to and supported by said rigid boards in non-conducting relationship with the outer wall extending into an interior furnace chamber, and heating elements supported on ends of said hanger means projecting inwardly of said liner.

7. A furnace according to claim 6 wherein clips secured to said outer wall hold said rigid boards at positions to compress said soft batts.

8. A unit according to claim 7 wherein pins extend from said clip angles and through said plurality of soft batts layers and into a rigid board to hold the same adjacent the outer wall.

9. Apparatus according to claim 6 wherein contacting surfaces of laterally adjacent batts are engaged along intrfaces which do not define a straight path for heat to transfer therealong.

10. In a furnace having an outer wall lined with an insulating lining and internal electrical resistance heating elements adjacent the lining, the combination comprising:

layers of rigid insulating material arranged in vertically spaced apart horizontal layers along the interior of said outer wall, batts of insulating ceramic fiber stacked vertically along the outer furnace wall to define a substantial portion of the furnace wall lining, said layers and batts being of substantially the same size and shape, hanger means releasably supported by said rigid layers in non-conducting relationship with said outer wall and extending into an interior furnace chamber to support heating elements.

11. A furnace according to claim 10 wherein said electric heating unit comprises a flat ribbon heating element, said hanger means having straight heating element support surfaces in engagement with said flat heating element.

12. A furnace according to claim 10 wherein ends of said hanger means are detachably interconnected with said rigid layers and extend therefrom with the weight of the electric heating unit acting as cantilever weight on said hanger means to assist in retaining the hanger means on said rigid layers.

13. A furnace according to claim 10 wherein said rigid layers have vertical orifices therethrough, and an end of one of said hanger means extends through said orifices and said rigid layer.

14. A furnace according to claim 13 wherein said hanger means have hooked ends which extend through said orifices, a portion of said hooked ends abutting the bottoms of said rigid layers, the cantilever weight carried by said hanger means assisting in retaining said hooked end in interengagement with said orifices.

15. A furnace according to claim 10 wherein groove means in said rigid layer laterally position said hanger means.

16. A furnace according to claim 10 wherein between about 3 and about 40 soft batt layers are compressed between successive rigid layers.

17. A furnace according to claim 16 wherein the compressed height of said soft batts is between about 70 percent and about 90 percent of their noncompressed height.

18. A furnace according to claim 10 wherein between about 75% and about 95% of the vertical height of said apparatus in the region carrying said heating elements is comprised of said soft batt layers.

19. A furnace according to claim 10 wherein clip angles secured to said outer wall hold said rigid layers against said soft batts.

20. A furnace according to claim 19 wherein pins extend from said clip angles, through said plurality of soft batt layers and into the next successive rigid layer to align said batt layers against said outer wall.

21. A furnace according to claim 10 wherein contacting surfaces of laterally adjacent batts are engaged along interefaces which do not define a straight path for heat to transfer therealong.

22. A method of lining an electrical resistance heating furnace having an outer wall to support heating elements in non-conducting relationship with said outer wall comprising:

arranging batts of soft insulating material in a plurality of vertical layers around the interior of said outer wall, arranging slabs of rigid insulating material in a horizontal layer vertically adjacent said plurality of soft batt layers, securing said rigid batt layers against said soft batt layers and compressing the soft batt layers, and releasably attaching hangers to said rigid slabs in non-conducting relationship with said outer wall to extend into an interior furnace cavity.

23. A method according to claim 22 including impaling said batt layers on pin means associated with said securing means to align said batt layers along the interior of said outer wall.

24. Insulating and heating element support apparatus for an electric heating unit having an outer wall comprising:

slabs of rigid insulating material arranged in vertically spaced apart horizontal layers along the interior of said outer wall, batts of soft insulating material arranged in horizontal layers and being disposed between successive layers of rigid slabs, orifices through said rigid slabs, and hangers each having a hooked end insertable through one of said orifices to detachably engage therewith, a segment of said hangers lying along the upper surface of said rigid layer, said hangers being releasably attached to said rigid slabs, and an end on said hangers extending into an interior furnace cavity to support heating elements.

25. Apparatus according to claim 24 in which a portion of said hooked end abuts the bottoms of said rigid layer, the cantilever weight carried by said hanger assisting retaining said hooked end in interengagement with said orifices.

26. A furnace in accordance with claim 6 in which said hanger means are elongated metal rods having a bent hook shaped end inserted into an aperture of one of said insulating boards.

* * * * *